United States Patent [19]

Brownawell et al.

[11] Patent Number: 5,042,617

[45] Date of Patent: Aug. 27, 1991

[54] METHOD OF REDUCING THE PRESENCE OF SLUDGE IN LUBRICATING OILS

[75] Inventors: Darrell W. Brownawell, Scotch Plains; Warren Thaler, Flemington, both of N.J.

[73] Assignee: Exxon Research & Engineering Company, Florham Park, N.J.

[21] Appl. No.: 404,040

[22] Filed: Sep. 7, 1989

[51] Int. Cl.[5] ..... F01M 1/10

[52] U.S. Cl. ..... 184/6.24; 208/180; 123/196 A

[58] Field of Search ..... 208/179, 180; 210/457, 210/502.1, 282; 184/6.24; 252/28, 29, 50, 52 R, 52 A

[56] References Cited

U.S. PATENT DOCUMENTS

| | | | |
|---|---|---|---|
| 2,093,430 | 9/1937 | Franklin | 196/16 |
| 2,343,427 | 3/1944 | Wells | 252/326 |
| 2,361,092 | 10/1944 | Gilbert et al. | 210/457 |
| 2,366,190 | 1/1945 | Hurn | 252/9 |
| 2,446,489 | 8/1948 | Schaafsma | 208/179 |
| 2,609,931 | 9/1952 | Rodman | 210/483 |
| 2,796,989 | 6/1957 | Knovacs | 210/282 |
| 3,558,478 | 1/1971 | Geyer et al. | 184/6.24 |
| 3,749,247 | 7/1973 | Rohde | 210/205 |
| 3,985,642 | 10/1976 | Friel | 208/810 |
| 4,066,559 | 1/1978 | Rohde | 252/10 |
| 4,069,157 | 1/1978 | Hoover et al. | 270/433 M |

FOREIGN PATENT DOCUMENTS

| | | | |
|---|---|---|---|
| 156417 | 5/1954 | Australia | 210/502.1 |
| 134873 | 10/1979 | Japan | 210/502.1 |

*Primary Examiner*—E. Rollins Cross
*Assistant Examiner*—Erick Solis
*Attorney, Agent, or Firm*—John W. Ditsler

[57] ABSTRACT

Sludge can be effectively removed from a lubricating oil by contacting the oil with a dispersant functional group immobilized on a substrate. This results in improved engine cleanliness and control of viscosity increases.

24 Claims, No Drawings

METHOD OF REDUCING THE PRESENCE OF SLUDGE IN LUBRICATING OILS

BACKGROUND OF THE INVENTION

1. Field of the Invention

This invention concerns removing sludge from a lubricating oil by contacting the oil with a dispersant functional group incorporated on an immobilized substrate through which the oil is passed.

2. Description of Related Art

During combustion of fuel (e.g. gasoline) in an internal combustion engine, certain polar hydrocarbon contaminants (e.g. low molecular weight polar alkyl compounds such as alcohols, aldehydes, ketones, carboxylic acids, and the like) are formed due to incomplete combustion of the fuel. These sludge and varnish precursors are passed into the lubricating oil with the combustion gases where the precursors contact water in the oil and agglomerate to form an emulsion which is commonly referred to as sludge. The presence of sludge in the oil is undesirable because it tends to increase the oil's viscosity, promote the presence of varnish in the oil, and plug oil ways.

For many years, dispersants have been used in lubricating oils to greatly increase the capacity of the oil to suspend sludge. This in turn decreases the sludge's detrimental effect on viscosity, varnish, and oil way plugging. However, at some point, an oil's capacity to protect an engine becomes limited, even with the most potent dispersant. In addition, dispersants in current use suspend sludge in such a finely divided form that the sludge passes through currently available filters and remains in the oil.

Therefore, it would be desirable to have available a simple, yet convenient method for removing sludge from a lubricating oil and thereby avoid the deleterious effects of leaving the sludge suspended in the oil.

SUMMARY OF THE INVENTION

This invention concerns a method for removing sludge from a lubricating oil. More specifically, sludge can be effectively removed from used lubricating oils by contacting the sludge with a dispersant functional group that is immobilized on a substrate through which the oil is passed. While not wishing to be bound by any particular theory, we believe that the sludge and varnish precursors complex with the dispersant functional group and become immobilized on the substrate. In a preferred embodiment, the substrate is immobilized within the lubrication system of an internal combustion engine. Preferably, the dispersant functional group is polyethylene amine which is incorporated on a substrate comprising alumina spheres within a conventional oil filter.

DETAILED DESCRIPTION OF THE INVENTION

Conventional dispersants comprise a solubilizing group such as polyisobutylene and a functional group that complexes or reacts with the sludge and varnish precursors (hereinafter referred to as dispersant functional group). However, according to this invention, sludge can be removed from a lubricating oil without the need for a solubilizing group by incorporating (e.g. reacting or depositing) a dispersant functional group on or with a substrate that is immobilized. Essentially any dispersant functional group which will complex with sludge or varnish precursors can be used. Examples of suitable dispersant functional groups are amines, polyamines, morpholines, oxazolines, piperazines, alcohols, polyols, polyethers, or substituted versions thereof (e.g. alkyl, dialkyl, aryl, alkaryl or aralkyl amines, etc.) Preferred dispersant functional groups include polyethylene amines, other substituted amines (e.g. polypropylene amines), pentaerythritol, aminopropyl morpholine, their derivatives, or mixtures thereof. Examples of derivatives include, but are not limited to, salts of these dispersant functional groups; reaction products of these functional groups with sultones, cyclic anhydrides, or their neutralized derivatives (e.g. metal sulfonate or carboxylate salts); hydrocarbon insoluble polymers (organic or inorganic) bound to these functional groups; organic or inorganic polymer matrices in which these functional groups are bound or chemisorbed; and copolymers containing these functional groups. Examples of the latter include polymer films which incorporate polyethylene amines or polyolefins containing polyethylene amine in which the hydrocarbon portion has been rendered porous and insoluble. Polyethylene amines are a particularly effective functional group, with the sulfonate salt derivatives of polyethylene amine being preferred.

The precise amount of dispersant functional group incorporated on the substrate can vary broadly depending upon the amount of sludge in the oil. However, although only an amount effective (or sufficient) to reduce the sludge content of the lubricating oil need be used, the amount will typically range from about 0.1 to about 10 wt. %, preferably from about 0.2 to about 2.0 wt. %, based on weight of the lubricating oil, provided the dispersant functional group on the substrate is the only dispersant functional group in the system.

If desired, the substrate can be located within or external to the lubrication system of an internal combustion engine. Preferably, the substrate will be located within the lubrication system (e.g. on the engine block or near the sump). More preferably, the substrate will be part of the engine's filter system for filtering oil, although it could be separate therefrom. Suitable substrates include organic polymers, inorganic polymers, or their mixtures. The dispersant may be chemically bound to the substrate or physically incorporated into the substrate. Examples of suitable substrates include, but are not limited to, alumina, activated clay, cellulose, cement binder, silica-alumina, polymer matrices, activated carbon, and various polymers such as polyvinyl alcohol. High surface substrates such as alumina, cement binder, polymer matrices, and activated carbon are preferred. The dispersant-substrate composition can be formed into various shapes such as pellets or spheres. The substrate may (but need not) be inert (e.g. the substrate may also impart dispersant activity).

The dispersant functional group may be incorporated on or with the substrate by methods known to those skilled in the art. For example, if the substrate were alumina spheres, the dispersant functional group can be deposited by using the following technique. A salt of a sulfonate or carboxylate containing polyethylene amine is prepared and dissolved in water to make a concentrated solution. This solution is added to dry alumina spheres so that all the voids of the spheres are fitted. The spheres are then heated to evaporate the water, leaving a layer of sulfonate or carboxylate salt of polyethylene amine filling the pores of the alumina spheres.

Sludge is present in essentially any lubricating oil used in the lubrication system of essentially any internal combustion engine, including automobile and truck engines, two-cycle engines, aviation piston engines, marine and railroad engines, gas-fired engines, alcohol (e.g. methanol) powered engines, stationary powered engines, turbines, and the like. The sludge is produced during combustion and is blown passed the piston into the lubricating oil. In addition to sludge, the lubricating oil will normally comprise a major amount of lubricating oil basestock (or lubricating base oil), and a minor amount of one or more additives. The lubricating oil basestock can be derived from natural lubricating oils, synthetic lubricating oils, or mixtures thereof. In general, the lubricating oil basestock will have a viscosity in the range of about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, di-ethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like. Synthetic hydrocarbon oils are also obtained from hydrogenated oligomers of normal olefins.

Silicon-based oils (such as the polyakyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The lubricating base oil may contain one or more additives to form a fully formulated lubricating oil. Such lubricating oil additives include antiwear agents, antioxidants, corrosion inhibitors, detergents, pour point depressants, extreme pressure additives, viscosity index improvers, friction modifiers, and the like. These additives are typically disclosed, for example, in "Lubricant Additives" by C.V. Smalheer and R. Kennedy Smith, 1967, pp. 1–11 and in U.S. Pat. No. 4,105,571, the disclosures of which are incorporated herein by reference. Normally, there is from about 1 to about 20 wt. % of these additives in a fully formulated engine lubricating oil. Dispersants may also be included as additives in the oil if desired, although this invention partially or completely negates their need. However, the precise additives used (and their relative amounts) will depend upon the particular application of the oil.

This invention can also be combined with the removal of carcinogenic components from a lubricating oil, as is disclosed in European Patent Application 88300090.3 (published July 20, 1988 having Publication No. 0 275 148), the disclosure of which is incorporated herein by reference. For example, polynuclear aromatic hydrocarbons (especially PNA's with at least three aromatic rings) that are usually present in used lubricating oil can be substantially removed (i.e., reduced by from about 60 to about 90% or more) by passing the oil through a sorbent. The sorbent may be immobilized with the substrate described above or immobilized separate therefrom. Preferably, the substrate and sorbent will be located within the lubrication system of an internal combustion engine through which the oil must circulate after being used to lubricate the engine. Most preferably, the substrate and sorbent will be part of the engine filter system for filtering oil. If the latter, the sorbent can be conveniently located on the engine block or near the sump, preferably downstream of the oil as it circulates through the engine (i.e., after the oil has been heated). Most preferably, the sorbent is downstream of the substrate.

Suitable sorbents include activated carbon, attapulgus clay, silica gel, molecular sieves, dolomite clay, alumina, zeolite, or mixtures thereof. Activated carbon is preferred because (1) it is at least partially selective to the removal of polynuclear aromatics containing more than 3 aromatic rings, (2) the PNA's removed are tightly bound to the carbon and will not be leached-out to become free PNA's after disposal, (3) the PNA's removed will not be redissolved in the used lubricating oil, and (4) heavy metals such as lead and chromium may be removed as well. Although most activated carbons will remove PNA's to some extent, wood and peat based carbons are significantly more effective in removing four and higher ring aromatics than coal or coconut based carbons.

The amount of sorbent required will depend upon the PNA concentration in the lubricating oil. Typically, for five quarts of oil, about 20 to about 150 grams of activated carbon can reduce the PNA content of the used lubricating oil by up to 90%. Used lubricating oils usually contain from about 10 to about 10,000 ppm of PNA's.

It may be necessary to provide a container to hold the sorbent, such as a circular mass of sorbent supported on wire gauze. Alternatively, an oil filter could comprise the sorbent capable of combining with polynuclear aromatic hydrocarbons held in pockets of filter paper. These features would also be applicable to the substrate described above.

Any of the foregoing embodiments of this invention can also be combined with a sorbent (such as those described above) that is mixed, coated, or impregnated with additives normally present in lubricating oils, particularly engine lubricating oils (see European Patent Application 88300090.3 having Publication No. 0 275 148). In this embodiment, additives (such as the lubricating oil additives described above) are slowly released into the lubricating oil to replenish the additives as they are depleted during use of the oil. The ease with which the additives are released into the oil depends upon the nature of the additive and the sorbent. Preferably, however, the additives will be totally released within 150 hours of engine operation. In addition, the sorbent may contain from about 50 to about 100 wt. % of the additive (based on the weight of activated carbon), which generally corresponds to 0.5 to 1.0 wt. % of the additive in the lubricating oil.

Any of the foregoing embodiments may also be combined with a method for reducing piston deposits resulting from neutralizing fuel combustion acids in the piston ring zone (i.e., that area of the piston liner traversed by the reciprocating piston) of an internal combustion engine (such as is disclosed in copending application USSN 269,274 filed Nov. 9, 1988, now U.S. Pat. No. 4,906,389). More specifically these deposits can be reduced or eliminated from the engine by contacting the combustion acids at the piston ring zone with a soluble weak base for a period of time sufficient to neutralize a major portion (preferably essentially all) of the combustion acids and form soluble neutral salts which contain a weak base and a strong combustion acid.

This embodiment requires that a weak base be present in the lubricating oil. The weak base will normally be added to the lubricating oil during its formulation or manufacture. Broadly speaking, the weak bases can be basic organophosphorus compounds, basic organonitrogen compounds, or mixtures thereof, with basic organonitrogen compounds being preferred. Families of basic organophosphorus and organonitrogen compounds include aromatic compounds, aliphatic compounds, cycloaliphatic compounds, or mixtures thereof. Examples of basic organonitrogen compounds include, but are not limited to, pyridines; anilines; piperazines; morpholines; alkyl, dialkyl, and trialky amines; alkyl polyamines; and alkyl and aryl guanidines. Alkyl, dialkyl, and trialkyl phosphines are examples of basic organophosphorus compounds.

Examples of particularly effective weak bases are the dialkyl amines ($R_2HN$), trialkyl amines ($R_3N$), dialkyl phosphines ($R_2HP$), and trialkyl phosphines ($R_3P$), where R is an alkyl group, H is hydrogen, N is nitrogen, and P is phosphorus. All of the alkyl groups in the amine or phosphine need not have the same chain length. The alkyl group should be substantially saturated and from 1 to 22 carbons in length. For the di- and tri- alkyl phosphines and the di- and tri-alkyl amines, the total number of carbon atoms in the alkyl groups should be from 12 to 66. Preferably, the individual alkyl group will be from 6 to 18, more preferably from 10 to 18, carbon atoms in length.

Trialkyl amines and trialkyl phosphines are preferred over the dialkyl amines and dialkyl phosphines. Examples of suitable dialkyl and trialkyl amines (or phosphines) include tributyl amine (or phosphine), dihexyl amine (or phosphine), decylethyl amine (or phosphine), trihexyl amine (or phosphine), trioctyl amine (or phosphine), trioctyldecyl amine (or phosphine), tridecyl amine (or phosphine), dioctyl amine (or phosphine), trieicosyl amine (or phosphine), tridocosyl amine (or phosphine), or mixtures thereof. Preferred trialkyl amines are trihexyl amine, trioctadecyl amine, or mixtures thereof, with trioctadecyl amine being particularly preferred. Preferred trialkyl phosphines are trihexyl phosphine, trioctyldecyl phosphine, or mixtures thereof, with trioctadecyl phosphine being particularly preferred. Still another example of a suitable weak base is the polyethyleneamine imide of polybutenylsuccinie anhydride with more than 40 carbons in the polybutenyl group.

The weak base must be strong enough to neutralize the combustion acids (i.e., form a salt). Suitable weak bases will typically have a PKa from about 4 to about 12. However, even strong organic bases (such as organoguanidines) can be utilized as the weak base if the strong base is an appropriate oxide or hydroxide and is capable of releasing the weak base from the weak base/-combustion acid salt.

The molecular weight of the weak base should be such that the protonated nitrogen compound retains its oil solubility. Thus, the weak base should have sufficient solubility so that the salt formed remains soluble in the oil and does not precipitate. Adding alkyl groups to the weak base is the preferred method to ensure its solubility.

The amount of weak base in the lubricating oil for contact at the piston ring zone will vary depending upon the amount of combustion acids present, the degree of neutralization desired, and the specific applications of the oil. In general, the amount need only be that which is effective or sufficient to neutralize at least a portion of the combustion acids present at the piston ring zone. Typically, the amount will range from about 0.01 to about 3 wt. % or more, preferably from about 0.1 to about 1.0 wt. %.

Following neutralization of the combustion acids, the neutral salts are passed or circulated from the piston ring zone with the lubricating oil and contacted with a heterogenous strong base. By strong base is meant a base that will displace the weak base from the neutral salts and return the weak base to the oil for recirculation to the piston ring zone where the weak base is reused to neutralize combustion acids. Examples of suitable strong bases include, but are not limited to, barium oxide (BaO), calcium carbonate ($CaCO_3$), calcium oxide (CaO), calcium hydroxide ($Ca(OH)_2$) magnesium carbonate ($MgCO_3$), magnesium hydroxide (Mg(OH)2), magnesium oxide (MgO), sodium aluminate ($NaAlO_2$), sodium carbonate ($Na_2CO_3$), sodium hydroxide (NaOH), zinc oxide (ZnO), or their mixtures, with ZnO being particularly preferred. By "heterogenous strong base" is meant that the strong base is in a separate phase (or substantially in a separate phase) from the lubricating oil, i.e., the strong base is insoluble or substantially insoluble in the oil.

The strong base may be incorporated (e.g. impregnated) on or with a substrate immobilized in the lubricating system of the engine, but subsequent to (or downstream of) the piston ring zone. Thus, the substrate can be located on the engine block or near the sump. Preferably, the substrate will be part of the filter system for filtering oil, although it could be separate therefrom. Suitable substrates include, but are not limited to, alumina, activated clay, cellulose, cement binder, silica-alumina, and activated carbon. The alumina, cement binder, and activated carbon are preferred, with cement binder being particularly preferred. The substrate may (but need not) be inert.

The amount of strong base required will vary with the amount of weak base in the oil and the amount of combustion acids formed during engine operation. However, since the strong base is not being continuously regenerated for reuse as is the weak base (i.e., the alkyl amine), the amount of strong base must be at least equal to (and preferably be a multiple of) the equivalent weight of the weak base in the oil. Therefore, the amount of strong base should be from 1 to about 15 times, preferably from 1 to about 5 times, the equivalent weight of the weak base in the oil.

Once the weak base has been displaced from the soluble neutral salts, the strong base/strong combustion acid salts thus formed will be immobilized as heterogenous deposits with the strong base or with the strong base on a substrate if one is used. Thus, deposits which would normally be formed in the piston ring zone are not formed until the soluble salts contact the strong base. Preferably, the strong base will be located such that it can be easily removed from the lubrication system (e.g., included as part of the oil filter system).

Thus, this invention can be combined with removing PNA's from a lubricating oil, enhancing the performance of a lubricating oil by releasing conventional additives into the oil, reducing piston deposits in an internal combustion engine, or a combination thereof.

Although this invention has heretofore been described with specific reference to removing sludge from lubricating oils used in internal combustion engines, it can also be suitably applied to essentially any oil (e.g. industrial lubricating oils) that contains the polar hydrocarbon sludge or varnish precursors from which sludge is formed.

This invention may be further understood by reference to the following examples which are not intended to restrict the scope of the appended claims.

EXAMPLE 1

Preparation of Dispersant Immobilized on a Polymeric Substrate

A solution of 50g of polyvinyl alcohol (88% hydrolyzed, M.W. 96,000) in 400g anhydrous dimethylsulfoxide (DMSO) was prepared by stirring at 90° C.

A solution 39.5g toluene diisocyanate in 108g DMSO was stirred at 90° C. and 90g of the above polyvinyl alcohol solution (10g PVA) was added over about 10 min and stirred overnight (20.5 hrs). Then 45g (0.227 mole) of tetraethylene pentamine in 100g DMSO was added and stirred at 90° C. for 24 hrs. The product was mixed briefly in a blender with excess water and collected by filtration. The filter cake was washed three times with water. The cake was then washed with tetrahydrofuran (THF). Contact with THF changed it from a wet powder to a hard mass. The cake was rinsed with hexane and broken-up. After drying in a vacuum area at 50° C., a 32.2g yield of product was obtained. Analysis for N=18.78%, 18.59%.

The finely pulverized material was suitable for packing in an oil filter to remove sludge from the lubricating oil circulating within the lubrication system of an internal combustion engine.

Example 2

Preparation of Dispersant Immobilized on Cellulosic Filter Paper

Filter paper from a commercial automotive oil filter was placed in a dry dimethyl sulfoxide solution of a diisocyanate such as toluene diisocyate. Stirring under an inert dry atmosphere was continued for several days.

The paper was then washed three times using fresh DMSO. The paper was then placed in a solution of tetraethylene pentamine in DMSO and stirred for several days. The paper was then rinsed three times with DMSO and then with ether. Analysis after vacuum dry indicated that the paper had incorporated 2.4% nitrogen.

The resulting dispersant-containing filter paper was suitable for use in an oil filter to remove sludge from the lubricating oil circulating within the lubrication system of an internal combustion engine.

What is claimed is:

1. A method for reducing the presence of sludge in a lubricating oil which comprises (a) incorporating a dispersant functional group with an immobilized substrate, and (b) contacting the sludge in the lubricating oil with the dispersant functional group on the substrate, thereby causing at least a portion of the sludge in the lubricating oil to become immobilized on the substrate.

2. The method of claim 1 wherein the dispersant functional group is a polyamine, amine, morpholine, oxazoline, piperazine, alcohol, polyol, polyether, or substituted versions thereof.

3. The method of claim 2 wherein the dispersant functional group comprises a polyamine or a salt derivative thereof.

4. The method of claim 3 wherein the polyamine comprises polyethylene amine.

5. The method of claim 3 wherein the dispersant functional group is impregnated on a substrate comprising alumina.

6. The method of claim 1 wherein the substrate is alumina, activated clay, cellulose, cement binder, silica-alumina, a polymer matrix, activated carbon, or mixtures thereof.

7. The method of claim 6 wherein the substrate comprises alumina spheres.

8. A method for reducing the presence of sludge in a lubricating oil circulating within the lubrication system of an internal combustion engine which comprises (a) incorporating a dispersant functional group with a substrate that is immobilized within the lubrication system of the engine, and (b) contacting the sludge in the lubricating oil with the dispersant functional group on the substrate, thereby causing at least a portion of the sludge in the lubricating oil to become immobilized on the substrate.

9. The method of claim 8 wherein the dispersant functional group is a polyamine, amine, morpholine, oxazoline, piperazine, alcohol, polyol, polyether, or substituted versions thereof.

10. The method of claim 9 wherein the dispersant functional group comprises a polyamine or a salt derivative thereof.

11. The method of claim 10 wherein the polyamine comprises polyethylene amine.

12. The method of claim 11 wherein the polyamine is impregnated on a substrate comprising alumina.

13. The method of claim 8 wherein the substrate is alumina, activated clay, cellulose, cement binder, silica-alumina, a polymer matrix, activated carbon, or mixtures thereof.

14. The method of claim 13 wherein the substrate comprises alumina spheres.

15. The method of claim 8 wherein polynuclear aromatic compounds are present in the lubricating oil and are removed therefrom by contacting the oil with a sorbent located within the lubrication system.

16. The method of claim 15 wherein the sorbent is included within the engine oil filter.

17. The method of claim 16 wherein the sorbent and the substrate comprise the same material.

18. The method of claim 16 wherein the sorbent comprises activated carbon and the substrate comprises alumina spheres.

19. The method of claim 15 wherein the sorbent is impregnated with at least one engine lubricating oil additive.

20. The method of claim 8 wherein a sorbent impregnated with at least one engine lubricating oil additive is also immobilized within the lubrication system of the engine.

21. The method of claim 20 wherein the lubricating oil additive is an antiwear agent, an antioxidant, a friction modifier, or mixtures thereof.

22. The method of claim 20 wherein the sorbent is included within the engine oil filter.

23. The method of claim 8 wherein the substrate is located within the engine oil filter.

24. The method of claim 8 wherein a weak base is present in the lubricating oil, a heterogeneous strong base is incorporated with the substrate, the internal combustion engine has a piston ring zone, and fuel combustion acids are present in the piston ring zone, such that when the weak base contacts the combustion acids soluble neutral salts are formed which circulate to the substrate and contact the strong base, thereby displacing a portion of the weak base from the soluble neutral salt into the lubricating oil and resulting in the formation of a strong base/combustion acid salt immobilized with the strong base on the substrate.

* * * * *